US007004853B2

(12) United States Patent
Deshmukh

(10) Patent No.: US 7,004,853 B2
(45) Date of Patent: Feb. 28, 2006

(54) HIGH DENSITY ALLOY FOR IMPROVED MASS PROPERTIES OF AN ARTICLE

(75) Inventor: Uday V. Deshmukh, Oceanside, CA (US)

(73) Assignee: Callaway Golf Company, Carlsbad, CA (US)

( * ) Notice: Subject to any disclaimer, the term of this patent is extended or adjusted under 35 U.S.C. 154(b) by 2 days.

(21) Appl. No.: 10/604,518

(22) Filed: Jul. 28, 2003

(65) Prior Publication Data

US 2005/0026724 A1 Feb. 3, 2005

(51) Int. Cl.
*A63B 53/04* (2006.01)

(52) U.S. Cl. ..... 473/332; 473/342; 473/350

(58) Field of Classification Search ..... 473/324, 473/332, 342, 349–350
See application file for complete search history.

(56) References Cited

U.S. PATENT DOCUMENTS

| | | | | |
|---|---|---|---|---|
| 4,664,383 | A | | 5/1987 | Aizawa et al. |
| 4,667,963 | A | | 5/1987 | Yoneyama |
| 4,792,139 | A | | 12/1988 | Nagasaki et al. |
| 4,798,383 | A | | 1/1989 | Nagasaki et al. |
| 4,848,747 | A | | 7/1989 | Fujimura et al. |
| 4,884,812 | A | | 12/1989 | Nagasaki et al. |
| 4,928,972 | A | | 5/1990 | Nakanishi et al. |
| 4,964,640 | A | | 10/1990 | Nakanishi et al. |
| 4,995,609 | A | | 2/1991 | De La Cruz |
| 5,120,062 | A | | 6/1992 | Scheie et al. |
| 5,190,290 | A | | 3/1993 | Take |
| 5,228,694 | A | | 7/1993 | Okumoto et al. |
| D347,254 | S | | 5/1994 | Iinuma |
| 5,326,106 | A | | 7/1994 | Meyer |
| 5,333,872 | A | | 8/1994 | Manning et al. |
| D353,644 | S | | 12/1994 | Hirsch et al. |
| 5,375,840 | A | | 12/1994 | Hirsch et al. |
| D354,786 | S | | 1/1995 | Manning et al. |
| 5,411,264 | A | | 5/1995 | Oku |
| 5,423,546 | A | | 6/1995 | Manning et al. |
| 5,472,201 | A | | 12/1995 | Aizawa et al. |
| D366,082 | S | | 1/1996 | Dekura |
| 5,497,995 | A | | 3/1996 | Swisshelm |
| D368,756 | S | | 4/1996 | Blough et al. |
| D368,947 | S | | 4/1996 | Blough et al. |
| 5,531,444 | A | * | 7/1996 | Buettner ..... 473/349 |
| 5,547,194 | A | | 8/1996 | Aizawa et al. |
| 5,595,552 | A | | 1/1997 | Wright et al. |
| 5,800,282 | A | * | 9/1998 | Hutin et al. ..... 473/291 |
| 6,238,302 | B1 | | 5/2001 | Dewanjee et al. |
| 6,434,811 | B1 | | 8/2002 | Helmstetter et al. |
| D464,387 | S | | 10/2002 | Rollinson et al. |
| D464,693 | S | | 10/2002 | Rollinson et al. |
| 6,471,600 | B1 | | 10/2002 | Tang et al. |
| D474,822 | S | | 5/2003 | Cleveland et al. |
| 6,758,764 | B1 | * | 7/2004 | Chen et al. ..... 473/349 |
| 6,814,674 | B1 | * | 11/2004 | Clausen et al. ..... 473/342 |

* cited by examiner

*Primary Examiner*—Stephen Blau
(74) *Attorney, Agent, or Firm*—Michael A. Catania; Elaine H. Lo

(57) ABSTRACT

The present invention is a nickel-tungsten-chromium alloy for an article of manufacture such as a portion of a golf club head (20). The nickel-tungsten-chromium alloy preferably has a density ranging from 9.0 g/cm$^3$ to 10.5 g/cm$^3$, and a Rockwell Hardness ranging from 50 to 92. The nickel-tungsten-chromium alloy is capable of being investment cast to form the article of manufacture.

10 Claims, 7 Drawing Sheets

HIGH DENSITY ALLOY FOR IMPROVED MASS PROPERTIES OF AN ARTICLE

CROSS REFERENCE TO RELATED APPLICATIONS

Not Applicable

FEDERAL RESEARCH STATEMENT

[Not Applicable]

BACKGROUND OF INVENTION

1. Field of the Invention

The present invention relates to a high density alloy for an article of manufacture. More specifically, the present invention relates to a high density alloy for an iron golf club.

2. Description of the Related Art

Current materials do not allow for sufficient design flexibility to manipulate the mass properties of certain articles of manufacture such as golf club heads. The density of metallic materials may be manipulated by mixing elemental powders in specific proportions and then pressing and sintering the mixture to form a dense body. However, this process does not necessarily create a metallic alloy since the local composition is quite different from the bulk composition. Further, such a sintering process creates manufacturing difficulties and does not provide sufficient mechanical properties.

Investment casting is a well-known and simple manufacturing process for creating numerous metallic articles such as golf club heads. High density metals such as molybdenum (10.2 grams per cubic centimeter ("g/cm$^3$")), tantalum (16.6 g/cm$^3$) and tungsten (19.3 g/cm$^3$) cannot be used directly since these high density metals are extremely refractory. Other high density metals such as gold (19.3 g/cm$^3$), silver (10.5 g/cm$^3$) and platinum (21.4 g/cm$^3$) are too expensive for high volume low cost articles, and these high priced metals do not possess the requisite mechanical properties.

Iron (7.86 g/cm$^3$) and nickel (8.90 g/cm$^3$) are not very refractory, have good mechanical properties and are reasonably priced for high volume low cost articles. Binary phase diagrams for Fe—W and Ni—W demonstrate that nickel is capable of dissolving substantially more tungsten than iron in solid state. Nickel is capable of dissolving 30 weight percent tungsten in solid phase while the solubility of tungsten in iron is limited. Further, the density of iron is lower than nickel thereby requiring more tungsten to achieve a higher density. Both of these conditions result in an iron-tungsten alloy being multiple-phase rather than a desired single phase, with an intermetallic phase that is brittle and difficult to polish. Further, a single phase is better for finishing, more malleable and has better corrosion resistance.

One specific article of manufacture is an iron-type golf club head, which are typically composed of a stainless steel or titanium material, and are typically cast or forged. Most golfers desire that their irons have a large sweet spot for greater forgiveness, a low center of gravity to get the ball in the air, a solid sound, reduced vibrations during impact, and a trim top line for appearance. Unfortunately, these desires are often in conflict with each other as it pertains to an iron.

The use of iron club heads composed of different materials has allowed some prior art irons to achieve some of these desires.

One example is U.S. Pat. No. 5,228,694 to Okumoto et al., which discloses an iron club head composed of a stainless steel sole and hosel, a core composed of a bulk molding compound or the like, a weight composed of a tungsten and polyamide resin, and an outer-shell composed of a fiber-reinforced resin.

Another example is set forth in U.S. Pat. Nos. 4,792,139, 4,798,383 and 4,884,812, all to Nagasaki et al., which disclose an iron club head composed of stainless steel with a fiber reinforced plastic back plate to allow for weight adjustment and ideal inertia moment adjustment.

Another example is U.S. Pat. No. 4,848,747 to Fujimura et al., which discloses a metal iron club head with a carbon fiber reinforced plastic back plate to increase the sweet spot. A ring is used to fix the position of the back plate.

Another example is set forth in U.S. Pat. Nos. 4,928,972 and 4,964,640 to Nakanishi et al., which disclose an iron club head composed of stainless steel with a fiber reinforcement in a rear recess to provide a dampening means for shock and vibrations, a means for increasing the inertial moment, a means for adjusting the center of gravity and a means for reinforcing the back plate.

Another example is U.S. Pat. No. 5,190,290 to Take, which discloses an iron club head with a metal body, a filling member composed of a light weight material such as a plastic, and a fiber-reinforced resin molded on the metal body and the filling member.

Another example is U.S. Pat. No. 5,411,264 to Oku, which discloses a metal body with a backwardly extended flange and an elastic fiber face plate in order to increase the moment of inertia and minimize head vibrations.

Another example is U.S. Pat. No. 5,472,201 to Aizawa et al., which discloses an iron club head with a body composed of stainless steel, a face member composed of a fiber reinforced resin and a protective layer composed of a metal, in order to provide a deep center of gravity and reduce shocks.

Another example is U.S. Pat. No. 5,326,106 to Meyer, which discloses an iron golf club head with a metal blade portion and hosel composed of a lightweight material such as a fiber reinforced resin.

Another example is U.S. Pat. No. 4,664,383 to Aizawa et al., which discloses an iron golf club head with a metal core covered with multiple layers of a reinforced synthetic resin in order to provide greater ball hitting distance.

Another example is U.S. Pat. No. 4,667,963 to Yoneyama, which discloses an iron golf club head with a metal sole and a filling member composed of a fiber reinforced resins material in order to provide greater hitting distance.

The prior art fails to disclose an iron golf club head that is composed of multiple materials, has a low center of gravity, reduced vibrations, and a greater moment of inertia.

SUMMARY OF INVENTION

The present invention is a nickel-tungsten-chromium alloy for use in article of manufacture. The nickel-tungsten-chromium alloy is preferably castable, preferably has a density ranging from 9.0 g/cm$^3$ to 10.5 g/cm$^3$, and preferably has a Rockwell Hardness ranging from 50 to 85. The tungsten provides the increased density of the alloy while the chromium provides increased Rockwell hardness and corrosion resistance.

One aspect of the present invention is an iron-type golf club head with a portion of the golf club head composed of a castable nickel-tungsten-chromium alloy with a density ranging from 9.0 g/cm$^3$ to 10.5 g/cm$^3$, and a Rockwell Hardness ranging from 50 to 85.

Another aspect of the present invention is an iron-type golf club head entirely composed of a castable nickel-tungsten-chromium alloy with a density ranging from 9.0 g/cm$^3$ to 10.5 g/cm$^3$, and a Rockwell Hardness ranging from 50 to 85.

Yet another aspect of the present invention is an article of manufacture with a portion of the article composed of a castable nickel-tungsten-chromium alloy with a density ranging from 9.0 g/cm$^3$ to 10.5 g/cm$^3$, and a Rockwell Hardness ranging from 50 to 92.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
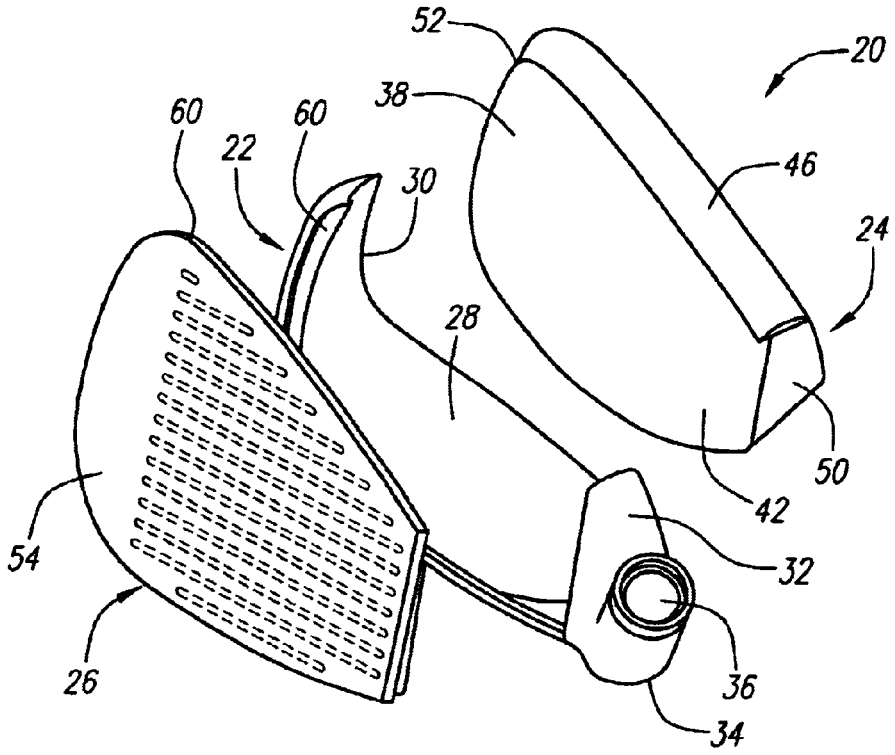
FIG. 1 is an exploded view of an iron club head according to a first embodiment.
Figure 2:
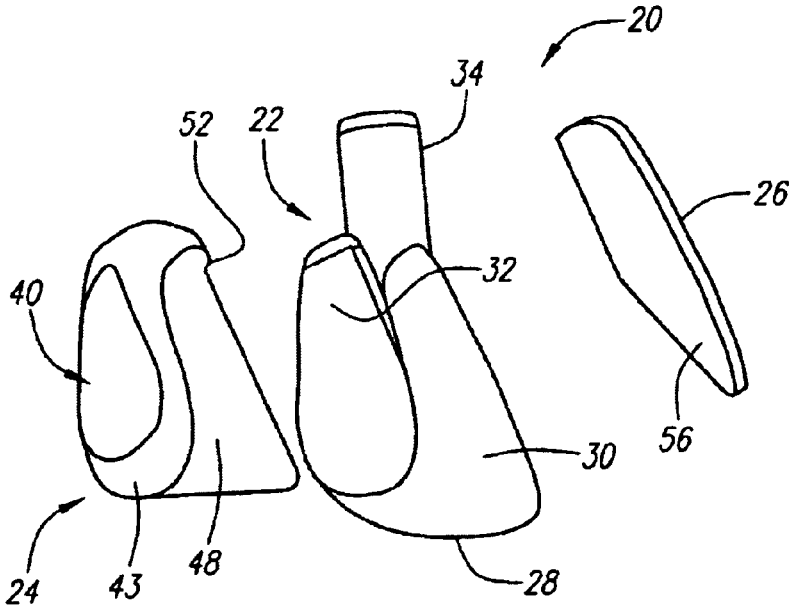
FIG. 2 is a side exploded view of the iron club head of FIG. 1.
Figure 3:
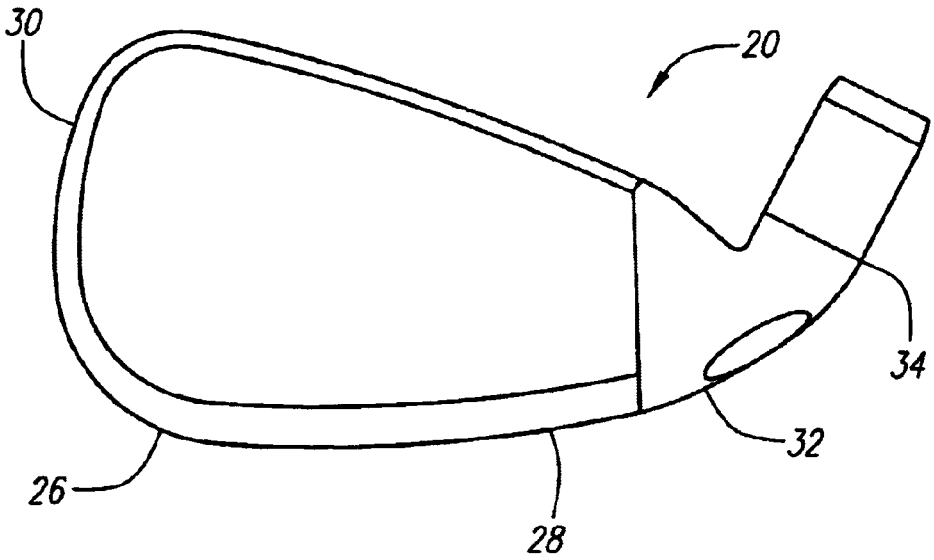
FIG. 3 is a front plan view of the iron club head of FIG. 1.
Figure 4:
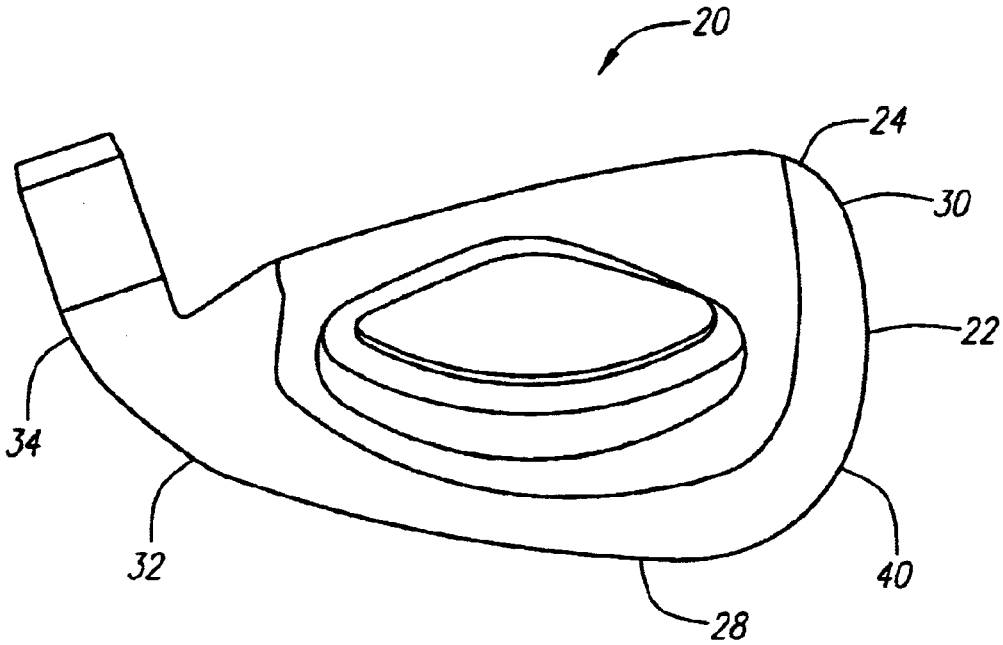
FIG. 4 is a rear plan view of the iron club head of FIG. 1.

The article of manufacture of the present invention is composed of a nickel-tungsten-chromium alloy. The nickel-tungsten-chromium alloy allows the article of manufacture to have good mechanical properties, corrosion resistance, a high polished appearance, capable of being investment cast, low cost, and the like.

The nickel-tungsten-chromium alloy of the present invention preferably comprises 35 to 70 weight percent nickel, 20–35 weight percent tungsten and 10–30 weight percent chromium. The nickel-tungsten-chromium alloy preferably has a density ranging from 9.0 g/cm$^3$ to 10.5 g/cm$^3$, more preferably from 9.2 g/cm$^3$ to 10.0 g/cm$^3$, and most preferably 9.3 g/cm$^3$. The nickel-tungsten-chromium alloy preferably has Rockwell Hardness ranging from 50 to 92, more preferably 75 to 92, and most preferably from 80 to 91.

Table One and Table Two provide information on examples of compositions of the nickel-tungsten-chromium alloy, densities of each of the examples of the nickel-tungsten-chromium alloy, and the Rockwell Hardness B of each of the examples of the nickel-tungsten-chromium alloy. A metallography of each of the examples indicates that each example is in the single solid phase. The Rockwell Hardness was measured using the standard test for Rockwell Hardness B as described in *Hardness Testing*, ASM International, 1987, which pertinent parts are hereby incorporated by reference. Example 7 was measured using the Rockwell Hardness C test, and the measurement for Example 7 was 34 on the Rockwell Hardness C scale. The results indicate that these examples of the nickel-tungsten-chromium alloy are capable of achieving a very shiny finish.

TABLE ONE

| Sample | Nickel wt % | Tungsten wt. % | Chromium wt. % | Silicon wt. % |
|---|---|---|---|---|
| 1 | 68 | 21 | 10 | 1 |
| 2 | 63 | 21 | 15 | 1 |
| 3 | 57 | 27 | 15 | 1 |
| 4 | 64 | 25 | 10 | 1 |
| 5 | 49 | 30 | 20 | 1 |
| 6 | 42 | 32 | 25 | 1 |
| 7 | 34 | 35 | 30 | 1 |
| 8 | 53 | 25 | 21 | 1 |

TABLE TWO

| Sample | Density g/cm3 | Rockwell Hardness B |
|---|---|---|
| 1 | 9.91 | 77 |
| 2 | 9.66 | 82 |
| 3 | 10.02 | 82 |
| 4 | 9.94 | 82 |
| 5 | 10.07 | 85 |
| 6 | 9.63 | 91.5 |
| 7 | 10.29 | — |
| 8 | 9.3 | 84 |

A preferred article of manufacture is a golf club head, most preferably an iron-type golf club head although the golf club head may be a putter or wood. Such a putter capable of using the nickel-tungsten-chromium alloy of the present invention is disclosed in U.S. Pat. No. 6,238,302 for A Golf Club Head With An Insert Having Integral Tabs and U.S. Pat. No. 6,471,600 for a Putter Head, both which are incorporated by reference in their entireties. Such a wood capable of using nickel-tungsten-chromium alloy of the present invention is disclosed in U.S. Pat. No. 6,434,811 for a Weighting System For A Golf Club Head, which is incorporated by reference in its entirety.

As shown in FIGS. 1–8, an iron golf club head in accordance with a first embodiment is generally designated 20. The club head 20 is preferably composed of three main components: a periphery member 22, a central member 24 and a face plate 26. The club head 20 can range from a 1-iron to a lob-wedge, with the loft angle preferably ranging from fifteen degrees to sixty degrees. The three main components are assembled into the club head 20 using a process such as disclosed in co-pending U.S. patent application Ser. No. 10/065,150, filed on Sep. 20, 2002, entitled Method For Manufacturing Iron Golf Club Head, which is hereby incorporated by reference in its entirety.

The periphery member 22 is composed of the nickel-tungsten-chromium alloy of the present invention. The periphery member 22 has a sole wall 28, a toe wall 30 extending upward from a toe end of the sole wall 28, a heel wall 32 extending upward from the sole wall 28 near a heel end of the sole wall 28, and a hosel 34 extending outward from the sole wall 28 at the heel end of the sole wall 28. The hosel 34 is preferably offset. The hosel 34 has a bore 36 for receiving a shaft, and the upper end of the hosel 34 preferably lies below an upper end of the toe wall 30 when the club head 20 is in the address position for striking a golf ball, not shown. The bore 36 preferably extends through the entire hosel 34 providing a short straight hollow hosel such as disclosed in U.S. Pat. No. 4,995,609, which pertinent parts are hereby incorporated by reference.

Figure 8:
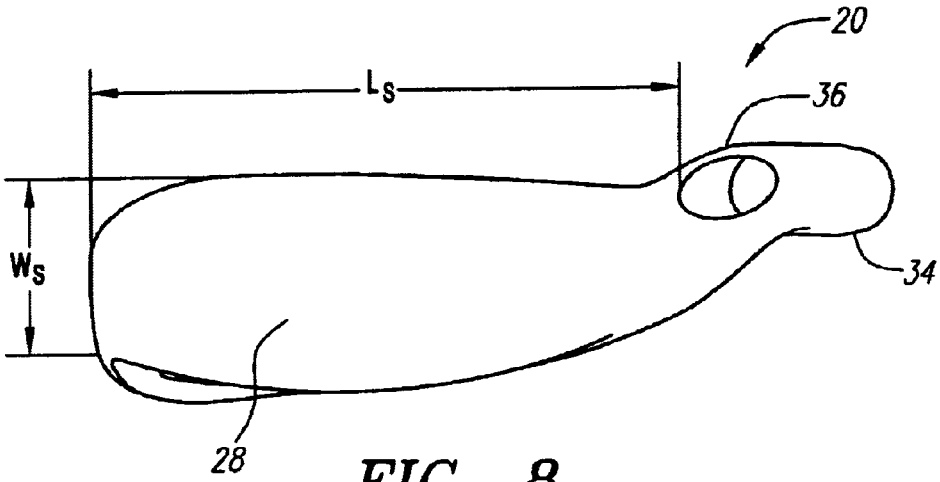
FIG. 8 is a bottom plan view of the iron club head of FIG. 1.
Figure 9:
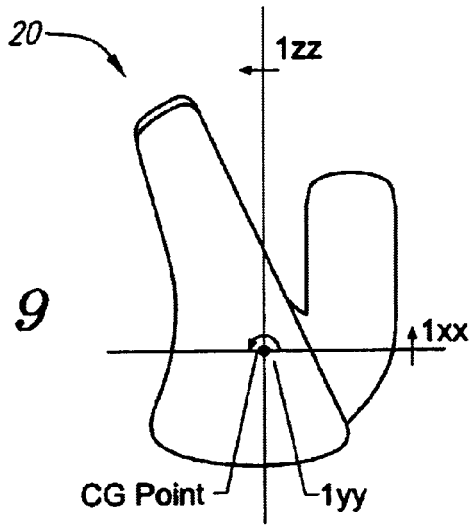
FIG. 9 is a toe side view of a golf club head illustrating the moments of inertia through the center of gravity.
Figure 10:
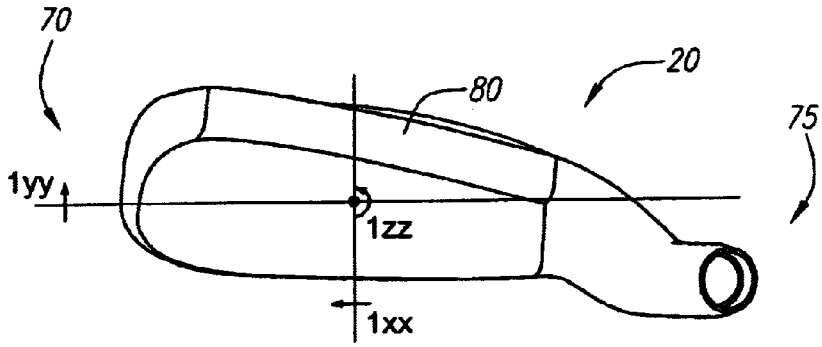
FIG. 10 is a top plan view of a golf club head illustrating the moments of inertia through the center of gravity.
Figure 11:
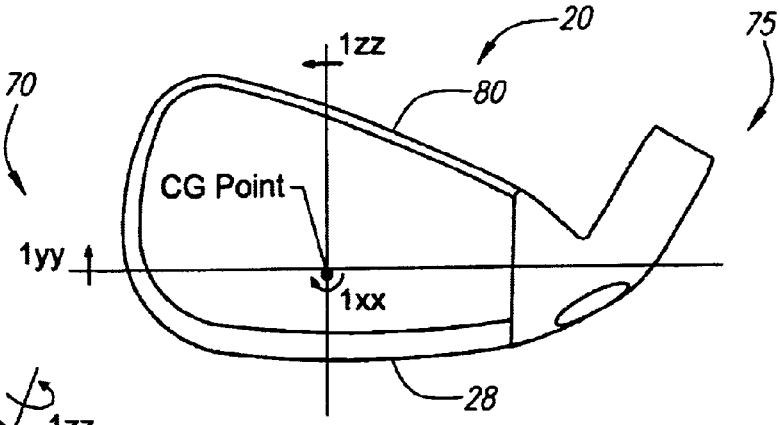
FIG. 11 is a front plan view of a golf club head illustrating the moments of inertia through the center of gravity.
Figure 12:
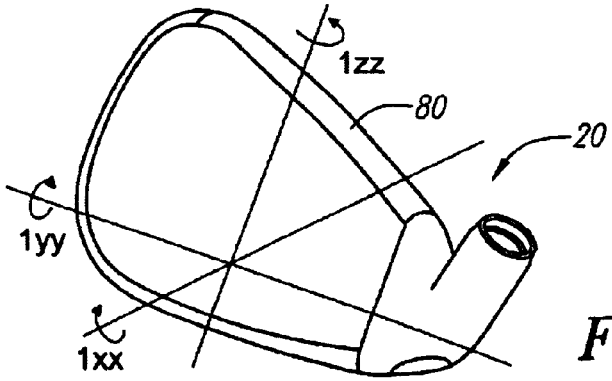
FIG. 12 is a front perspective view of a golf club head illustrating the moments of inertia through the center of gravity.
Figure 13:
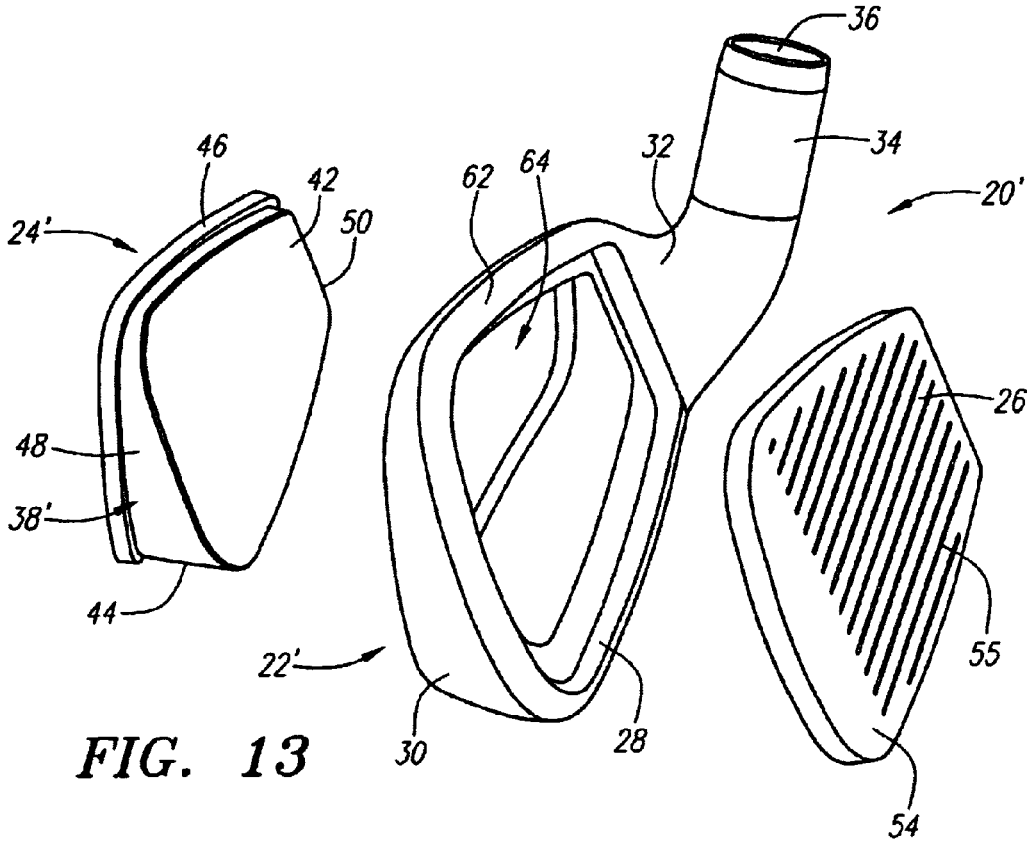
FIG. 13 is an exploded, front perspective view of an iron club head according to a second embodiment.
Figure 14:
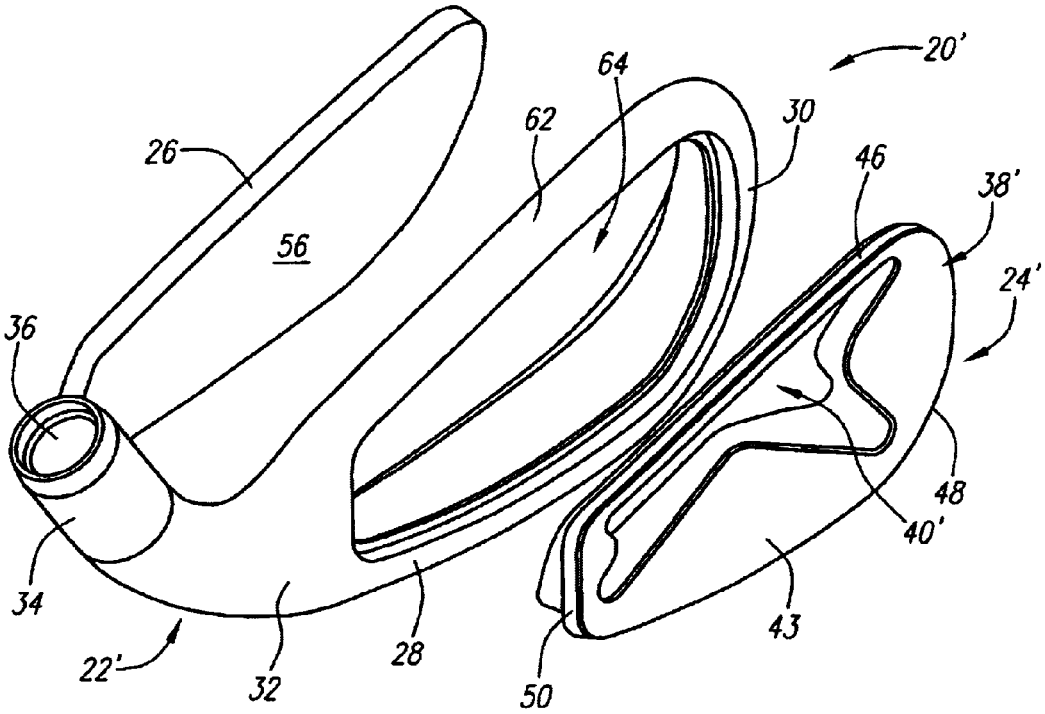
FIG. 14 is an exploded, rear perspective view of the iron club head of FIG. 13.
Figure 15:
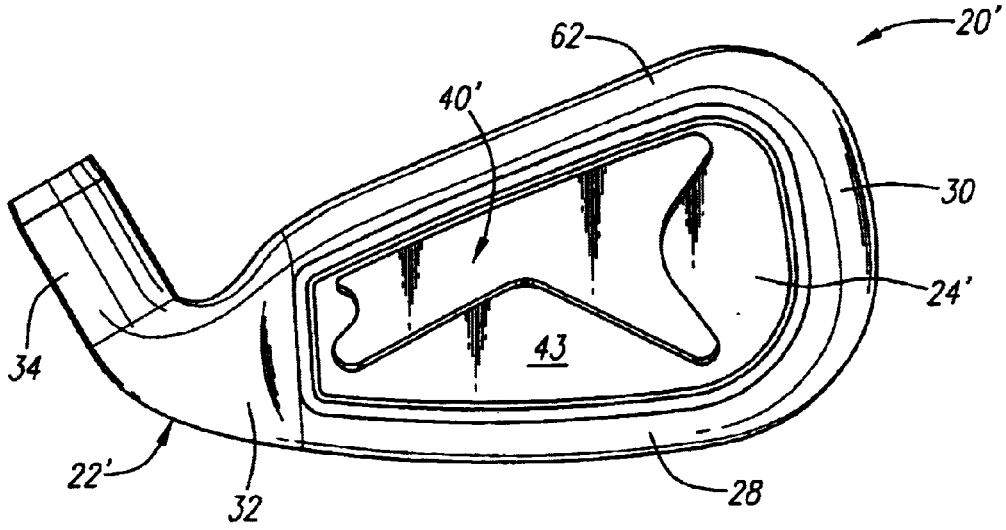
FIG. 15 is a rear plan view of the iron club head of FIG. 13.
Figure 16:
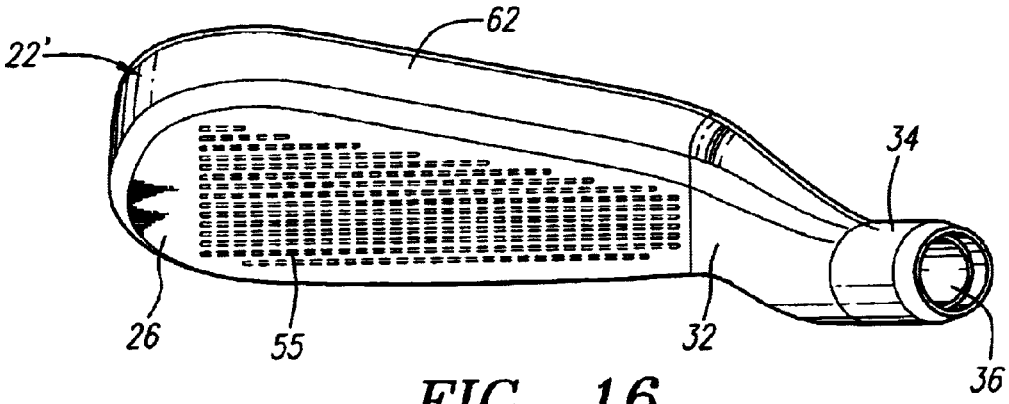
FIG. 16 is a top plan view of the iron club head of FIG. 13.
Figure 17:
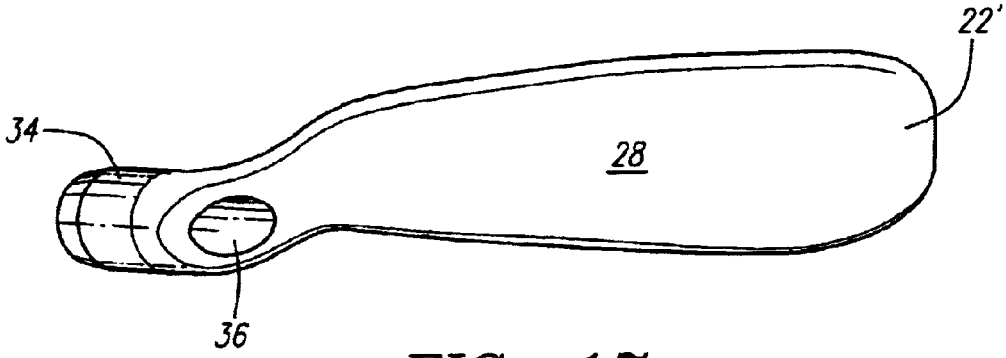
FIG. 17 is a bottom plan view of the iron club head of FIG. 13.
Figure 18:
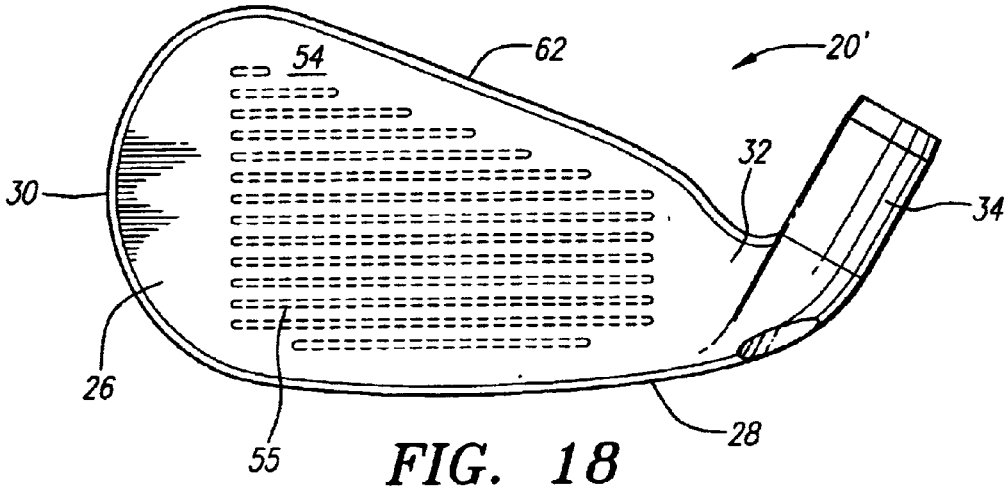
FIG. 18 is a front plan view of the iron club head of FIG. 13.
Figure 19:
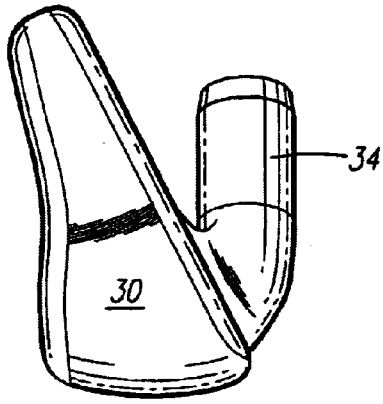
FIG. 19 is a toe side view of the iron club head of FIG. 13.
Figure 20:
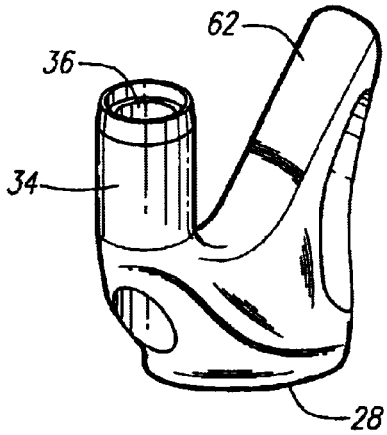
FIG. 20 is a heel side view of the iron club head of FIG. 13.

The sole wall 28 preferably has a cambered exterior surface, which contacts the ground during a golf swing. As shown in FIG. 8, the sole wall 28 has a width, "$W_S$", that preferably ranges from 1.00 inch to 1.75 inch, and is most preferably 1.25 inch. The sole wall 28 also has a length, "$L_S$", from a toe end to the beginning of the bore 36, which preferably ranges from 2.5 inches to 3.5 inches, and is most preferably 3.0 inches.

Figure 5:
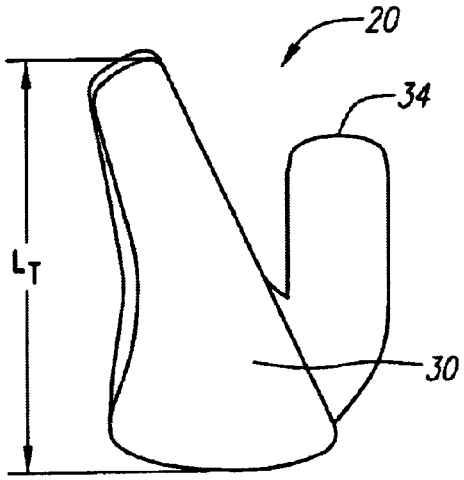
FIG. 5 is a toe side view of the iron club head of FIG. 1.

As shown in FIG. 5, the toe wall 30 preferably has a length, "$L_T$", which preferably ranges from 1.5 inches to 2.5 inches, and is most preferably 2.0 inches. The toe wall 30 preferably has a width that tapers from a lower end to an upper end of the toe wall 30.

Figure 6:
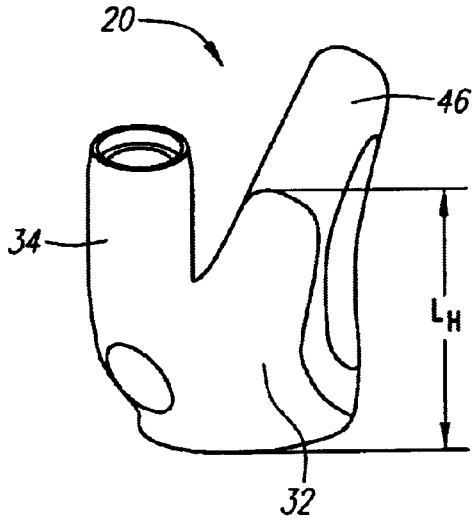
FIG. 6 is a heel side view of the iron club head of FIG. 1.
Figure 7:
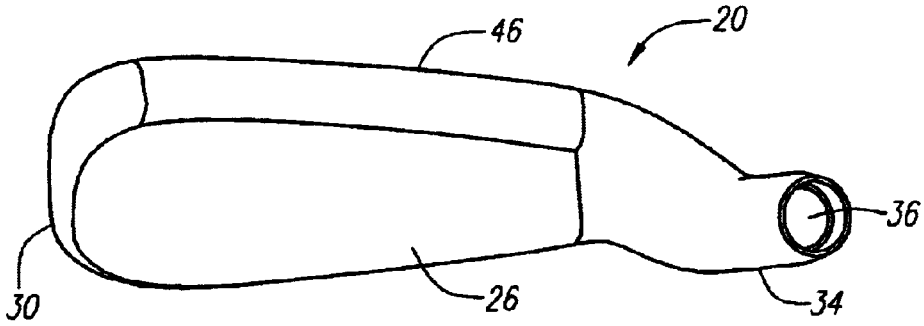
FIG. 7 is a top plan view of the iron club head of FIG. 1.

As shown in FIG. 6, the heel wall 32 preferably has a length, "$L_H$", which preferably ranges from 0.5 inch to 1.5 inches, and is most preferably 1.0 inch. The heel wall 32 preferably has a width that tapers from a lower end to an upper end of the heel wall 32.

In general, the periphery member 22 provides the club head 20 with a greater moment of inertia due to its relatively large mass along the periphery of the club head 20. Further, mass attributable to the sole wall 28 lowers the center of gravity of the club head 20 to promote a higher trajectory during ball striking. The periphery member 22 is preferably 15% to 50% of the volume of the club head 20 and preferably 50% to 80% of the mass of the club head 20.

The central member 24 is composed of a non-metal material. Preferred materials include bulk molding compounds, sheet molding compounds, thermosetting materials and thermoplastic materials. A preferred bulk molding compound is a resinous material with reinforcement fibers. Such resins include polyesters, vinyl esters and epoxy. Such fibers include carbon fibers, fiberglass, aramid or combinations. A preferred sheet molding compound is similar to the bulk molding compounds, however, in a sheet form. A preferred thermoplastic material includes injection moldable materials integrated with fibers such as disclosed above. These thermoplastic materials include polyesters, polyethylenes, polyamides, polypropylenes, polyurethanes, and the like.

The central member 24 is primarily a support for the face plate 26, and thus the central member should be able to withstand impact forces without failure. The central member 24 also reduces vibrations of the club head 20 during ball striking. The central member 24 is preferably 25% to 75% of the volume of the club head 20 and preferably 10% to 30% of the mass of the club head 20.

The central member 24 preferably has a body portion 38, a recess 40, a forward surface 42, a rear surface 43, a sole surface 44, a top surface 46, a toe surface 48, a heel surface 50 and a flange 52. The forward surface 42 is preferably at an angle approximate that of the club head 20. Thus, if the club head 20 is a 5-iron, then the forward surface preferably has an angle of approximately 27 degrees. The body portion 38 preferably tapers upward from the sole surface 44.

The central member 24 is disposed on an interior surface of the sole wall 28 of the periphery member 22. The toe surface 48 of the central member 24 preferably engages the interior surface of the toe wall 30 of the periphery member 22. The heel surface 50 of the central member 24 preferably engages the heel wall 32 of the periphery member 22. The top surface 46 preferably creates the top line of the club head 20. The flange 52 extends from the top surface 46 outward over the forward surface 42 thereby creating a top cover for securing the face plate 26. The face plate 26 is also secured within a ledge 60 of the periphery member 22.

The face plate 26 is preferably composed of a lightweight material. The lightweight material has a density that is preferably lower than the periphery member material. Such lightweight materials include titanium materials, stainless steel, amorphous metals and the like. Such titanium materials include pure titanium and titanium alloys such as 6-4 titanium alloy, 6-22-22 titanium alloy, 4-2 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. The face plate 26 is preferably manufactured through casting, forging, forming, machining, powdered metal forming, metal-injection-molding, electro-chemical milling, and the like.

The face plate 26 has an interior surface 56, which preferably engages the forward surface 42 of the central member 24, and an exterior surface 54 which preferably has scorelines (not shown) thereon. The face plate preferably has a thickness that ranges from 0.040 inch to 0.250 inch, more preferably from 0.06 inch to 0.130 inch, and most preferably 0.075 inch.

The club head 20 preferably has a total volume that ranges from 40.0 $cm^3$ to 60.0 $cm^3$, more preferably from 45.0 $cm^3$ to 55.0 $cm^3$, and most preferably 50.8 $cm^3$. The club head 20 preferably has a mass that ranges from 240 grams to 270 grams, more preferably from 245 grams to 260 grams, and most preferably 253 grams.

The periphery member 22 preferably has a total volume that ranges from 10.0 $cm^3$ to 32.0 $cm^3$, more preferably from 15.0 $cm^3$ to 20.0 $cm^3$, and most preferably 18.8 cm. The periphery member 22 preferably has a mass that ranges from 100 grams to 240 grams, more preferably from 150 grams to 200 grams, and most preferably 185 grams.

The central member 24 preferably has a total volume that ranges from 7.0 $cm^3$ to 35.0 $cm^3$, more preferably from 15.0 $cm^3$ to 30.0 $cm^3$, and most preferably 28.0 $cm^3$. The central member 24 preferably has a mass that ranges from 9 grams to 70 grams, more preferably from 25 grams to 60 grams, and most preferably 45 grams.

The face plate 26 preferably has a total volume that ranges from 4.0 $cm^3$ to 8.0 $cm^3$, more preferably from 4.5 $cm^3$ to 6.0 $cm^3$, and most preferably 5.3 $cm^3$. The face plate 26 preferably has a mass that ranges from 15 grams to 50 grams, more preferably from 20 grams to 30 grams, and most preferably 24 grams.

FIGS. 13–20 illustrate an iron golf club head in accordance with a second embodiment. The iron golf club head 20' includes a periphery member 22' composed of the nickel-tungsten-chromium alloy of the present invention, a central member 24' composed of a non-metal material, and a face plate 26 composed of a metal material having a lower density than the material of the periphery member 22'.

The periphery member 22' is similar to the periphery member 22 of the first embodiment and has a sole wall 28, a toe wall 30, a heel wall 32, and a hosel 34 with a bore 36 for receiving a shaft. In addition, the periphery member 22' has a top wall 62, which extends from an upper end of the toe wall 30 to an upper end of the heel wall 32. The top wall 62, sole wall 28, toe wall 30 and heel wall 32 define an opening 64 through the periphery member 22'. The periphery member 22' has similar dimensions for sole wall 28, toe wall 30, and heel wall 32 as periphery member 22 of the club head 20 of the first embodiment.

The periphery member 22' provides the club head 20' with a greater moment of inertia due to its relatively large mass at the periphery of the club head 20'. Further, mass attributable to the sole wall 28 lowers the center of gravity of the club head 20' to promote a higher trajectory during ball striking. The periphery member 22' is preferably 15% to 50% of the volume of the club head 20' and preferably 50% to 80% of the mass of the club head 20'.

The central member 24' is composed of a non-metal material, such as a bulk molding compound, sheet molding compound, thermosetting material or thermoplastic material. The central member 24' supports the face plate 26 and acts to reduce vibrations of the club head 20' during ball striking. The central member 24' is preferably 25% to 75% of the volume of the club head 20' and preferably 10% to 30% of the mass of the club head 20'.

The central member 24' preferably has a body portion 38', a recess 40', a forward surface 42, a rear surface 43, a sole surface 44, a top surface 46, a toe surface 48, and a heel surface 50. The recess 40' is formed in the rear surface 43 of the body portion 38' and may have any of a number of suitable configurations. The body portion 38' preferably tapers upward from the sole surface 44.

The central member 24' is disposed in the opening 64 of the periphery member 22', with the sole surface 44 contacting an interior surface of the sole wall 28 of the periphery member 22'. The toe surface 48 of the central member 24' preferably engages the interior surface of the toe wall 30 of the periphery member 22'. The heel surface 50 of the central member 24' preferably engages the heel wall 32 of the periphery member 22'. The top surface 46 preferably engages the interior surface of the top wall 62 of the periphery member 22'.

The face plate 26 is also disposed in the opening 64 of the periphery member 22'. The periphery member 22' is preferably swaged to secure the face plate 26 in the opening 64. Alternatively, the face plate 26 may be welded to the periphery member 22' or secured in place by an adhesive. The face plate 26 has an interior surface 56, which preferably engages the forward surface 42 of the central member 24', and an exterior surface 54, which preferably has scorelines 55 formed thereon. As described above, the face plate 26 is composed of a lightweight material and preferably has a thickness that ranges from 0.040 inch to 0.250 inch, more preferably from 0.060 inch to 0.130 inch, and most preferably about 0.075 inch.

FIGS. 9–12 illustrate the axes of inertia through the center of gravity of the golf club head. The axes of inertia are designated X, Y and Z. The X axis extends from rear of the golf club head 20 through the center of gravity, CG, and to the face plate 26. The Y axis extends from the heel end 75 of the golf club head 20 through the center of gravity, CG, and to the toe end 70 of the golf club head 20. The Z axis extends from the sole wall through the center of gravity, CG, and to the top line 80.

As defined in *Golf Club Design, Fitting, Alteration & Repair*, $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 20, 20' are preferably measured using a test frame ($X^T$, $Y^T$, $Z^T$), and then transformed to a head frame ($X^H$, $Y^H$, $Z^H$). The center of gravity of a golf club head 20 may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z-axis for the golf club head 20, 20' preferably ranges from 2200 g-$cm^2$ to 3000 g-$cm^2$, more preferably from 2400 g-$cm^2$ to 2700 g-$cm^2$, and most preferably from 2472 g-$cm^2$ to 2617 g-$cm^2$. The moment of inertia, Iyy, about the Y-axis for the golf club head 20 preferably ranges from 400 g-$cm^2$ to 700 g-$cm^2$, more preferably from 500 g-$cm^2$ to 600 g-$cm^2$, and most preferably from 530 g-$cm^2$ to 560 g-$cm^2$. The moment of inertia, Ixx, about the X-axis for the golf club head 20 preferably ranges from 2450 g-$cm^2$ to 3200 g-$cm^2$, more preferably from 2500 g-$cm^2$ to 2900 g-$cm^2$, and most preferably from 2650 g-$cm^2$ to 2870 g-$cm^2$.

For comparison, the new BIG BERTHA® 5-iron from Callaway Golf Company of Carlsbad, Calif., has a moment of inertia, Izz, of 2158 g-$cm^2$, a moment of inertia, Iyy, of 585 g-$cm^2$, and a moment of inertia, Ixx, of 2407 g-$cm^2$.

The article of manufacture is formed by investment casting of the nickel-tungsten-chromium alloy using a standard open-air investment casting procedure. The investment casting is generally conducted at a temperature of 1720 degrees Celsius. Use of 1 weight percent silicon is preferred to provide fluidity of the other elements in the melt during the casting process, which will allow for the filling of thin walls and a reduction in porsosity.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. An iron golf club head comprising:

a periphery member having a sole wall, a toe wall extending upward from the sole wall at a first end of the sole wall, a hosel extending upward from the sole wall at a second end of the sole wall, and a heel wall extending upward from the sole wall, the periphery member composed of a nickel-tungsten-chromium alloy having a density ranging from 9.0 g/cm$^3$ to 10.5 g/cm$^3$, and a Rockwell Hardness ranging from 50 to 92;

a central member coupled to the periphery member, the central member being composed of a non-metal material and having a body portion with a forward surface, a rear surface, a sole surface, a top surface, a toe surface, and a heel surface, the central member having a cavity formed in the rear surface of the body portion; and a face plate composed of a metal material having a lower density than the nickel-tungsten-chromium alloy, the face plate being coupled to the periphery member and disposed over the forward surface of the central member.

2. The iron golf club head according to claim 1, wherein the periphery member further includes a top wall extending from an upper end of the toe wall to an upper end of the heel wall.

3. The iron golf club head according to claim 1, wherein the metal material of the face plate comprises a titanium alloy.

4. The iron golf club head according to claim 1, wherein the central member is composed of a bulk molding compound.

5. The iron golf club head according to claim 1, wherein the central member is composed of a thermoplastic material.

6. The iron golf club head according to claim 5, wherein the face plate has a thickness ranging from 0.040 inch to 0.250 inch.

7. The iron golf club head according to claim 1, wherein the central member further includes a flange extending from the top surface at an intersection of the top surface and the forward surface, and wherein a top line of the face plate is in contact with the flange of the central member.

8. The iron golf club head according to claim 1, wherein the club head has a moment of inertia Ixx through the center of gravity of at least 2600 g-cm$^2$ and a moment of inertia Izz through the center of gravity of at least 2400 g-cm$^2$.

9. The iron golf club head according to claim 1 wherein the periphery member has a volume percentage of the golf club head ranging from 15% to 50%, and a mass percentage of the golf club head ranging from 50% to 80%.

10. The iron golf club head according to claim 1 wherein the central member has a volume percentage of the golf club head ranging from 25% to 75%, and a mass percentage of the golf club head ranging from 10% to 30%.

* * * * *